US009150970B2

(12) United States Patent
Bulan et al.

(10) Patent No.: US 9,150,970 B2
(45) **Date of Patent: *Oct. 6, 2015**

(54) PROCESS FOR ELECTROLYSIS OF ALKALI METAL CHLORIDES WITH OXYGEN-CONSUMING ELECTRODES IN MICRO-GAP ARRANGEMENT

(71) Applicant: BAYER INTELLECTUAL PROPERTY GMBH, Monheim (DE)

(72) Inventors: Andreas Bulan, Langenfeld (DE); Jürgen Kintrup, Leverkusen (DE)

(73) Assignee: Bayer Intellectual Property GmbH, Monheim (DE)

( * ) Notice: Subject to any disclaimer, the term of this patent is extended or adjusted under 35 U.S.C. 154(b) by 93 days.

This patent is subject to a terminal disclaimer.

(21) Appl. No.: 13/777,294

(22) Filed: Feb. 26, 2013

(65) Prior Publication Data

US 2013/0240371 A1 Sep. 19, 2013

(30) Foreign Application Priority Data

Mar. 15, 2012 (DE) ..... 10 2012 204 042

(51) Int. Cl.

| | |
|---|---|
| ***C25B 9/10*** | (2006.01) |
| ***C25B 1/14*** | (2006.01) |
| ***C25B 1/46*** | (2006.01) |
| ***C25B 15/02*** | (2006.01) |
| ***C25B 9/08*** | (2006.01) |

(52) U.S. Cl.

CPC ... *C25B 1/14* (2013.01); *C25B 1/46* (2013.01); *C25B 9/08* (2013.01); *C25B 15/02* (2013.01)

(58) Field of Classification Search

USPC ..... 205/517, 537

See application file for complete search history.

(56) References Cited

U.S. PATENT DOCUMENTS

| | | | | |
|---|---|---|---|---|
| 4,364,806 | A | 12/1982 | Rogers | |
| 4,578,159 | A | 3/1986 | Miles et al. | |
| 6,117,286 | A | 9/2000 | Shimamune et al. | |
| 2009/0071820 | A1* | 3/2009 | Saiki et al. | 204/252 |

FOREIGN PATENT DOCUMENTS

| | | | |
|---|---|---|---|
| JP | 3553775 | B2 | 8/2004 |
| JP | 2004-300510 | A | 10/2004 |
| WO | 01/57290 | A1 | 8/2001 |
| WO | 2008009661 | A2 | 1/2008 |

* cited by examiner

*Primary Examiner* — Arun S Phasge

(74) *Attorney, Agent, or Firm* — Norris McLaughlin & Marcus PA

(57) ABSTRACT

Process for electrolysis of alkali metal chlorides with oxygen-consuming electrodes having specific operating conditions for startup and shutdown, which prevents damage to constituents of the electrolysis cell.

6 Claims, No Drawings

PROCESS FOR ELECTROLYSIS OF ALKALI METAL CHLORIDES WITH OXYGEN-CONSUMING ELECTRODES IN MICRO-GAP ARRANGEMENT

The invention relates to a process for electrolysis of aqueous solutions of alkali metal chlorides with oxygen-consuming electrodes under specific operating conditions.

BACKGROUND OF THE INVENTION

The invention proceeds from electrolysis processes known per se for electrolysis of aqueous alkali metal chloride solutions using oxygen-consuming electrodes in the form of gas diffusion electrodes which typically comprise an electrically conductive carrier and a gas diffusion layer comprising a catalytically active component.

Various proposals for operation of the oxygen-consuming electrodes in electrolysis cells on the industrial scale are known in principle from the prior art. The basic idea is to replace the hydrogen-evolving cathode in the electrolysis (for example in chloralkali electrolysis) with the oxygen-consuming electrode (cathode). An overview of the possible cell designs and solutions can be found in the publication by Moussallem et al. "Chlor-Alkali Electrolysis with Oxygen Depolarized Cathodes: History, Present Status and Future Prospects", J. Appl. Electrochem. 38 (2008) 1177-1194.

The oxygen-consuming electrode—also called OCE for short hereinafter—has to meet a series of requirements to be usable in industrial electrolyzers. For instance, the catalyst and all other materials used have to be chemically stable against concentrated alkali metal hydroxide solutions and towards pure oxygen at a temperature of typically 80-90° C. Similarly, a high degree of mechanical stability is required, such that the electrodes can be installed and operated in electrolyzers with a size typically more than 2 $m^2$ in area (industrial scale). Further desirable properties are: high electrical conductivity, low layer thickness, high internal surface area and high electrochemical activity of the electrocatalyst. Suitable hydrophobic and hydrophilic pores and an appropriate pore structure for transmission of gas and electrolyte are needed. Long-term stability and low production costs are further particular requirements on an industrially usable oxygen-consuming electrode.

A problem in the case of arrangement of an OCE in a cathode element where an electrolyte gap is present between membrane and OCE arises from the fact that, on the catholyte side, the hydrostatic pressure forms a pressure gradient over the height of the electrode, which is opposed on the gas side by a constant pressure over the height. The effect of this can be that, in the lower region of the electrode, the hydrophobic pores too are flooded and liquid gets onto the gas side. On the other hand, in the case of excessively high gas pressure in the upper part of the OCE, liquid can be displaced from the hydrophilic pores and oxygen can get onto the catholyte side. Both effects reduce the performance of the OCE. In practice, the effect of this is that the construction height of an OCE is limited to about 30 cm unless further measures are taken. In industrial electrolysers, electrodes are typically constructed with a height of 1 m or higher. For the implementation of such construction heights, various technologies have been described.

WO2001/57290 A1 describes a cell in which the liquid is conducted from the top downwards through a flat porous element mounted between OCE and ion exchange membrane, called a percolator, in a kind of free-falling liquid film, called falling film for short, along the OCE (finite gap arrangement).

In this arrangement, no liquid column bears on the liquid side of the OCE, and no hydrostatic pressure profile builds up over the construction height of the cell. However, the construction described in WO2001/57290A1 is very complex. In order to ensure a homogeneous alkali flow and homogeneous contact of the OCE with catholyte, percolator, ion exchange membrane and OCE must be positioned very accurately.

In another embodiment, the ion exchange membrane which, in the electrolysis cell, divides the anode space from the cathode space directly adjoins the OCE without an intervening space into which the alkali metal hydroxide solution is introduced and from which it is removed (catholyte gap). This arrangement is also referred to as the zero gap arrangement. The zero gap arrangement is typically also employed in fuel cell technology. A disadvantage here is that the alkali metal hydroxide solution which forms has to be passed through the OCE to the gas side and then flows downwards at the OCE. In the course of this, the pores in the OCE must not be blocked by the alkali metal hydroxide solution, and there must not be any crystallization of alkali metal hydroxide in the pores. It has been found that a very high alkali metal hydroxide solution concentration can arise here, but it is stated that the ion exchange membrane at these high concentrations lacks long-term stability (Lipp et al., J. Appl. Electrochem. 35 (2005) 1015—Los Alamos National Laboratory "Peroxide formation during chlor-alkali electrolysis with carbon-based ODC").

A further arrangement, which is occasionally also referred to as "zero gap" but is more accurately formulated as "micro-gap", is described in JP3553775 and U.S. Pat. No. 6,117,286A1. In this arrangement, a further layer of a porous hydrophilic material which absorbs the aqueous alkali formed due to its absorptivity and from which at least a portion of the alkali can drain away downwards is present between the ion exchange membrane and the OCE. The means of draining of the aqueous alkali is determined by the installation of the OCE and the cell design. The advantage of this arrangement is that the amount of alkali which flows downwards on the reverse side of the OCE becomes smaller. As a result, the side of the OCE facing the gas side (reverse side) becomes more accessible to the oxygen. In addition, the pore system of the OCE is exposed to a smaller amount of liquid, as a result of which more pore volume is available for gas transport. In contrast to above-described finite gap arrangements, no aqueous alkali metal hydroxide solution (alkali) is conducted through the gap between OCE and ion exchange membrane as a result of application and drainage; the porous material present in the micro-gap absorbs the aqueous alkali formed and passes it onwards in horizontal or vertical direction. The arrangement described in JP3553775 and U.S. Pat. No. 6,117,286A1 is referred to hereinafter as "micro-gap". A high-performance electrolysis cell with a micro-gap configuration is easier to construct and to operate than the an electrolysis cell in finite gap arrangement.

An oxygen-consuming electrode consists typically of a support element, for example a plate of porous metal or a metal wire mesh, and an electrochemically catalytically active coating. The electrochemically active coating is microporous and consists of hydrophilic and hydrophobic constituents. The hydrophobic constituents make it difficult for electrolyte to penetrate through and thus keep the corresponding pores in the OCE unblocked for the transport of the oxygen to the catalytically active sites. The hydrophilic constituents enable the electrolyte to penetrate to the catalytically active sites, and the hydroxide ions to be transported away from the OCE. The hydrophobic component used is generally a fluorinated polymer such as polytetrafluoroethylene (PTFE), which additionally serves as a polymeric binder for particles of the catalyst. In the case of electrodes with a silver catalyst, for example, the silver serves as a hydrophilic component. A multitude of compounds have been described as electrochemical catalysts for the reduction of oxygen. However, only platinum and silver have gained practical significance as catalysts for the reduction of oxygen in alkaline solutions.

Platinum has a very high catalytic activity for the reduction of oxygen. Due to the high costs of platinum, it is used exclusively in supported form. A preferred support material is carbon. However, stability of carbon-supported, platinum-based electrodes in long-term operation is inadequate, probably because platinum also catalyses the oxidation of the support material. Carbon additionally promotes the unwanted formation of $H_2O_2$, which likewise causes oxidation. Silver likewise has a high electrocatalytic activity for the reduction of oxygen.

Silver can be used in carbon-supported form, and also as fine metallic silver. Even though the carbon-supported silver catalysts are more durable than the corresponding platinum catalysts, the long-term stability thereof under the operating conditions in an oxygen-consuming electrode, especially in the case of use for chloralkali electrolysis, is limited.

In the case of production of OCEs comprising unsupported silver catalyst, the silver is preferably introduced at least partly in the form of silver oxides, which are then reduced to metallic silver. The reduction is generally effected when the electrolysis cell is first started up. The reduction of the silver compounds also results in a change in the arrangement of the crystals, more particularly also to bridge formation between individual silver particles. This leads to overall consolidation of the structure.

It has been observed that, when the electrolysis current is switched off, the silver catalyst can be oxidized again. The oxidation is apparently promoted by the oxygen and the moisture in the half-cell. The oxidation can result in rearrangements in the catalyst structure, which have adverse effects on the activity of the catalyst and hence on the performance of the OCE.

It has also been found that the performance, especially the electrolysis voltage required, in an OCE with a silver catalyst depends considerably on the startup conditions. This applies both to the first startup of an OCE and to the further startups after a shutdown. It is one of the objects of the present invention to find specific conditions for the operation and especially the shutdown and startup of an OCE with a silver catalyst, which ensure a high performance of the OCE.

A further central element of the electrolysis cell is the ion exchange membrane. The membrane is pervious to cations and water and substantially impervious to anions. The ion exchange membranes in electrolysis cells are subject to severe stress: They have to be stable towards chlorine on the anode side and to severe alkaline stress on the cathode side at temperatures around 90° C. Perfluorinated polymers such as PTFE typically withstand these stresses. The ions are transported via acidic sulphonate groups and/or carboxylate groups polymerized into these polymers. Carboxylate groups exhibit higher selectivity; the polymers containing carboxylate groups have lower water absorption and have higher electrical resistance than polymers containing sulphonate groups. In general, multilayer membranes are used, with a thicker layer containing sulphonate groups on the anode side and a thinner layer containing carboxylate groups on the cathode side. The membranes are provided with a hydrophilic layer on the cathode side or both sides. To improve the mechanical properties, the membranes are reinforced by the inlaying of wovens or knits; the reinforcement is preferably incorporated into the layer containing sulphonate groups.

Due to the complex structure, the ion exchanger membranes are sensitive to changes in the media surrounding them. Different molar concentrations can result in formation of significant osmotic pressure gradients between the anode and cathode sides. When the electrolyte concentrations decrease, the membrane swells as a result of increased water absorption. When the electrolyte concentrations increase, the membrane releases water and shrinks as a result; in the extreme case, withdrawal of water can cause precipitation of solids in the membrane.

Concentration changes can thus cause disruption and damage at the membrane. The result may be delamination of the layer structure (blister formation), as a result of which the mass transfer or the selectivity of the membrane deteriorates.

In addition, pinholes and, in the extreme case, cracks can occur, which can result in unwanted mixing of anolyte and catholyte.

In production plants, it is desirable for electrolysis cells to be operated over periods of several years, without opening them in the meantime. Due to variation in demand volumes and faults in production sectors upstream and downstream of the electrolysis, electrolysis cells in production plants, however, inevitably have to be repeatedly run down and back up again.

On shutdown and restart of the electrolysis cells, there occur conditions which can lead to damage to the cell elements and considerably reduce the lifetime thereof. More particularly, oxidative damage has been found in the cathode space, as have damage to the OCE and damage to the membrane.

The prior art discloses few modes of operation with which the risk of damage to the electrolysis cells in the course of startup and shutdown can be reduced.

A measure known from conventional membrane electrolysis is the maintenance of a polarization voltage, which means that, when the electrolysis is ended, the potential difference is not downregulated to zero, but maintained at the level of the polarization voltage. In practical terms, a somewhat higher voltage than that required for the polarization is set, so as to result in a constant low current density and a small degree of resultant electrolysis. However, in the case of use of OCEs, this measure alone is insufficient to prevent oxidative damage to OCEs in the course of startup and shutdown.

Published specification JP 2004-300510 A describes an electrolysis process using a micro-gap arrangement, in which corrosion in the cathode space is to be prevented by flooding the gas space with sodium hydroxide solution on shutdown of the cell. The flooding of the gas space with sodium hydroxide solution accordingly protects the cathode space from corrosion, but gives inadequate protection from damage to the electrode and the membrane on shutdown and startup, or during shutdown periods.

U.S. Pat. No. 4,578,159A1 states that, for an electrolysis process using a zero gap arrangement, purging the cathode space with 35% sodium hydroxide solution prior to startup of the cell, or starting up the cell with low current density and gradually increasing the current density, can prevent damage to membrane and electrode. This procedure reduces the risk of damage to membrane and OCE during startup, but does not give any protection from damage during shutdown and shutdown periods.

Document U.S. Pat. No. 4,364,806A1 discloses that exchange of the oxygen for nitrogen after downregulating the electrolysis current will prevent corrosion in the cathode space. According to WO2008009661A2, the addition of a small proportion of hydrogen to the nitrogen will give rise to an improvement in protection from corrosion damage. The methods mentioned, however, are complex, especially from a safety point of view, and entail the installation of additional equipment for nitrogen and hydrogen supply. On restart, the pores of the OCE are partly filled with nitrogen and/or hydrogen, which prevents the supply of oxygen to the reactive sites. The process also does not give any protection from damage to the ion exchange membrane and places high safety requirements for avoidance of explosive gas mixtures.

The Final Technical Report "Advanced Chlor-Alkali Technology" by Jerzy Chlistunoff (Los Alamos National Laboratory, DOE Award 03EE-2F/Ed190403, 2004) details conditions for the temporary shutdown and startup of zero gap cells. In the case of shutdown, after the electrolysis current has been stopped, the oxygen supply is stopped and replaced by nitrogen. The moistening of the gas stream is increased in order to wash out the remaining sodium hydroxide solution. On the anode side, the brine is replaced by hot water (90° C.). The procedure is repeated until a stable voltage (open-circuit voltage) has been attained. The cells are then cooled, then the supply of moist nitrogen and the pumped circulation of the water on the anode side are stopped.

For the restart, the anode side is first filled with brine; on the cathode side, water and nitrogen are introduced. The cell is then heated to 80° C. Then the gas supply is switched to oxygen and a polarization voltage with low current flow is applied. Subsequently, the current density is increased and the pressure in the cathode is increased; the temperature rises to 90° C. Brine and water supply are subsequently adjusted such that the desired concentrations on the anode and cathode sides are attained.

The procedure described is very complex; more particularly, for industrial electrolysis processes, a very high level of complexity is required.

It should be stated that the techniques described to date for startup and shutdown of an OCE are disadvantageous and give only inadequate protection from damage.

It is an object of the present invention to provide suitable operating parameters for the startup and shutdown and the intervening shutdown periods of an electrolysis cell for chloralkali electrolysis using an OCE with micro-gap arrangement and a silver catalyst as the electrocatalytic substance, which are simple to perform and where compliance prevents damage to membrane, electrode and/or other components of the electrolysis cell.

SUMMARY OF THE INVENTION

The object is achieved by, on startup of an electrolysis cell with an OCE having a silver catalyst and micro-gap arrangement, wetting the cathode space and the OCE with an aqueous alkali having low contamination with chloride ions. On shutdown of an electrolysis cell having a silver catalyst and micro-gap arrangement, after the electrolysis voltage has been switched off, in a first step, the anolyte is released and the anode space is flushed and, in a subsequent step, catholyte still present is released and the cathode space is flushed.

DETAILED DESCRIPTION

The invention provides a process for chloralkali electrolysis with an electrolysis cell in a micro-gap arrangement, the cell having at least one anode space with anode and an anolyte comprising alkali metal chloride, an ion exchange membrane, a cathode space at least comprising an oxygen-consuming electrode as the cathode, the cathode comprising a silver-containing catalyst, and comprising a flat, porous element arranged between OCE and membrane, which porous element has a thickness of 0.01 mm to 2 mm and through which catholyte flows, and further comprising a gas space for an oxygen containing gas wherein application of the electrolysis voltage between anode and cathode is preceded, in a first step, by wetting of the oxygen-consuming electrode on the gas side with an aqueous alkali metal hydroxide solution having a content of chloride ions of not more than 1000 ppm, preferably not more than 700 ppm, more preferably not more than 500 ppm, and, after subsequent introduction of the anolyte into the anode space and of an oxygenous gas into the gas space of the cathode space, the electrolysis voltage is applied.

The invention further provides a process for chloralkali electrolysis with an electrolysis cell in a micro-gap arrangement, the cell having at least one anode space with anode and an anolyte comprising alkali metal chloride, an ion exchange membrane, a cathode space at least comprising an oxygen-consuming electrode as the cathode, the cathode comprising a silver-containing catalyst, and comprising a flat, porous element arranged between OCE and membrane, which porous element has a thickness of 0.01 mm to 2 mm and through which catholyte flows, and further comprising a gas space for an oxygen containing wherein, at the end of the electrolysis operation, for shutdown, at least the following steps are conducted in this sequence:

- lowering the electrolysis voltage and removing sufficient chlorine from the anolyte, to reach a content of less than 10 ppm of active chlorine in the anolyte,
- cooling the anolyte to a temperature below 60° C. and emptying the anode space,
- preferably refilling the anode space with one of the following liquids: dilute alkali metal chloride solution of not more than 4 mol/l or deionized water, with subsequent emptying of the anode space,
- filling the cathode space with one of the following liquids: dilute alkali metal hydroxide solution of not more than 4 mol/l or deionized water, with subsequent emptying of the cathode space.

These two above variants of the electrolysis process are, in a preferred embodiment, combined with one another, such that both the conditions described for the startup of the electrolysis and for the shutdown are complied with. This also includes the preferred variants described hereinafter.

In the cathode, strongly oxidative conditions exist as a result of the oxygen, and these can no longer be compensated for by the electrolysis current on shutdown. After the electrolysis current has been switched off, moreover, chloride ions diffuse to an increased extent through the membrane into the cathode space. Chloride ions promote corrosion processes; in addition, oxidation of the silver catalyst can form insoluble silver chloride. There is the risk of damage to the electrode and also to the entire cathode space.

When the electrolysis voltage is switched off, the mass transfer through the membrane caused by the current flow also stops. The membrane becomes deficient in water; there may be shrinkage and precipitation of solids and subsequently pinhole formation; the passage of anions through the membrane is facilitated. On restart, in turn, an excessively low water content hinders mass transfer through the membrane, as a result of which there may be a pressure increase and delamination at the interfaces.

Inhomogeneities in the water and/or ion distribution in the membrane and/or the OCE can, on restart, lead to local spikes in the current and mass transfer, and subsequently to damage to the membrane or the OCE.

Problems are also presented by the crystallization of alkali metal chloride salts on the anode side. The significant osmotic gradient between anolyte and catholyte results in water transport from the anode space to the cathode space. As long as the electrolysis is in operation, the water transport out of the anode space is countered by a loss of chloride and alkali metal ions, such that the concentration of alkali metal chloride falls in the anode space under standard electrolysis conditions. When the electrolysis is switched off, the water transport from the anode space into the cathode space caused by the osmotic pressure remains. The concentration in the anolyte rises above the saturation limit. The result is crystallization of alkali metal chloride salts, especially in the boundary region to the membrane, which can lead to damage to the membrane.

With the provision of the novel electrolysis processes according to the invention, the aforementioned problems and disadvantages of the processes known to date are overcome.

This is because it has been found that, surprisingly, electrolyzers comprising an OCE with a silver catalyst and micro-gap arrangement, through the sequence of these comparatively simpler steps, can repeatedly be put into and out of operation without damage, and do not incur any damage even in shutdown periods. The process is especially suitable for the electrolysis of aqueous sodium chloride and potassium chloride solutions.

The micro-gap configuration is preferably characterized in that a further layer of a porous, hydrophilic material of thickness 0.01-2 mm installed between the ion exchange membrane and the OCE absorbs the aqueous alkali formed due to its absorptivity and passes it onwards horizontally and vertically. The aqueous alkali formed can also drain downwards out of the micro-gap filled with the hydrophilic material if this is possible by virtue of the design of the cell or through the assembly of the cell. For example, slots could be arranged at the bottom, out of which the liquor can drain. The operating parameters for the startup and shutdown of an electrolysis cell are described hereinafter for an electrolysis cell having an OCE with a silver catalyst and micro-gap arrangement, which is operated after startup with an alkali metal chloride concentration (anolyte) of 2.5-4.0 mol/l and with establishment of an alkali metal hydroxide concentration (catholyte) of 8-14 mol/l, without wishing to restrict the execution to the procedure described. For the startup and shutdown of such an electrolysis cell, the following procedures are required: before startup, the cathode space and the OCE are wetted with a sodium hydroxide solution having low contamination with chloride ions. On shutdown, after switching off the electrolysis voltage, in a first step, the anolyte is released and the anode space flushed and, in a subsequent step, after emptying the cathode space of residues, the cathode space is flushed.

The startup of an electrolysis unit with micro-gap arrangement, an OCE having a silver catalyst and an ion exchange membrane soaked in alkaline water in accordance with the prior art is effected by, in a first step, wetting the cathode space with aqueous alkali. The wetting is effected, for example, by filling the cathode space with alkali metal hydroxide solution and emptying it immediately thereafter. The concentration of the aqueous alkali to be used is between 0.01 and 13.9 mol/l, preferably 0.1 to 4 mol, of alkali metal hydroxide per litre. The aqueous alkali must be very substantially free of chloride and chlorate ions.

Preference is given to a process which is characterized in that the alkali metal hydroxide solution introduced in the catholyte feed prior to application of the electrolysis voltage has a content of chloride ions of not more than 1000 ppm, preferably not more than 700 ppm, more preferably not more than 500 ppm.

Preference is given to a process which is characterized in that the alkali metal hydroxide solution introduced in the catholyte feed prior to application of the electrolysis voltage has a content of chlorate ions of not more than 20 ppm, preferably not more than 10 ppm.

The temperature of the alkali metal hydroxide solution for the wetting is 10-95° C., preferably 15-60° C.

The residence time of the alkali metal hydroxide solution in the cathode space corresponds at least to the time between complete filling and immediate emptying, meaning that, after complete filling, the alkali metal hydroxide solution is immediately released from the cathode space, but not more than 200 min.

After the alkali metal hydroxide solution has been released from the cathode space, oxygen is added. Preference is given to releasing the sodium hydroxide solution and adding the oxygen in such a way that the oxygen displaces the sodium hydroxide solution introduced. The positive pressure in the cathode is set in accordance with the configuration in the the cell, generally of the magnitude of 10 to 100 mbar.

The concentrations are determined by titration or another method known to those skilled in the art.

For the wetting of the cathode space, preference is given to using alkali metal hydroxide solution from regular production. Alkali from shutdown operations is less suitable for the wetting prior to startup of the cell particularly because of the contamination with chloride ions.

After the alkali metal hydroxide solution has been released from the cathode space, the anode space is filled with alkali metal chloride solution (brine). The brine meets the purity requirements customary for membrane electrolyses. After filling the anode space, the brine, according to the usual apparatus conditions, is conducted through the anode space in circulation by pumps. In the course of pumped circulation, the anolyte can be heated. The temperature of the brine supplied is selected such that a temperature of 30-95° C. is established in the output from the anode space. The alkali metal chloride concentration in the anolyte supplied is between 150 and 330 g/l.

After filling the anode space and starting up the anode circulation, the electrolysis voltage is applied in the next step. This preferably immediately follows filling of the anode and attainment of a temperature of the brine leaving the anode space of more than 60° C. It is advantageous when filling of the anode space is followed by switching-on at least of the polarization voltage or of the electrolysis voltage. The polarization voltage or electrolysis voltage is adjusted such that a current density of 0.01 $A/m^2$ to 40 $A/m^2$, preferably 10 to 25 $A/m^2$, is established. The time at this current density should not be more than 30 minutes, preferably not more than 20 minutes.

Overall, the total period for the startup should be kept to a minimum. The time after the filling of the anode space with brine and the attainment of an electrolysis power of >1 $kA/m^2$ should especially be less than 240 minutes, preferably less than 150 minutes. The electrolysis current density is preferably increased at a rate of 3 to 400 $A/m^2$ per minute. The electrolysis cell is then operated with the design parameters, for example with a concentration of 2.5-4.0 mol of alkali metal chloride per litre in the anode space, a current density of 2-6 $kA/m^2$ and a 50% to 100% excess of oxygen in the gas supply. The oxygen which is introduced into the cathode compartment is preferably saturated with water vapor at room temperature (ambient temperature). This can be effected, for example, by passing the oxygen through a water bath prior to introduction into the cathode compartment. It is likewise conceivable that the moistening is effected at higher temperature.

The sodium hydroxide solution concentration is established essentially through the choice of ion exchange membrane and of alkali metal chloride concentration in the anode space, typically between 8 and 14 mol/l. The alkali metal hydroxide solution advantageously flows out of the cathode space of its own accord.

The process described is suitable both for the first startup of electrolysis units after the installation of a silver-containing, especially of a silver oxide-containing, OCE which has not been operated before, and for the restart of electrolysis cells after a shutdown.

In the shutdown of the electrolysis cell, the following steps are conducted in this sequence:

- lowering the electrolysis voltage and removing chlorine from the anolyte, such that less than 10 ppm of active chlorine is present in the anolyte
- lowering the temperature of the anolyte to less than 60° C. (20-60° C.) and emptying the anode space
- preferably refilling the anode space with one of the following liquids: dilute alkali metal chloride solution of not more than 4 mol/l or deionized water
- emptying the anode space, preferably after 0.01 to 200 min
- filling the cathode space with one of the following liquids: dilute alkali metal hydroxide solution of 0.01 to 4 mol/l or deionized water
- emptying the cathode space, preferably after 0.01 to 200 min.

In a first step, the electrolysis voltage is downregulated. In this content, the voltage can be downregulated to zero. Preferably, after running down the electrolysis current, a voltage is maintained and this is only switched off after reduction of the chlorine content in the anode space to <10 mg/l, preferably less than 1 mg/l. Chlorine content is understood here to mean the total content of dissolved chlorine in the oxidation state of 0 or higher. The remaining chlorine is preferably removed from the anode space in such a way that chlorine-free anolyte is supplied with simultaneous removal of chlorine-containing anolyte, or by pumped circulation of the anolyte in the anode circuit with simultaneous separation and removal of chlorine gas. The voltage during this operation is adjusted such that a current density of 0.01 to 40 $A/m^2$, preferably 10 to 25 $A/m^2$, is established.

After switching off the electrolysis voltage, the anolyte is cooled to a temperature below 60° C. and then released.

Thereafter, the anode space is flushed. The flushing is effected with highly dilute brine having an alkali metal chloride content of 0.01 to 4 mol/l, with water or, preferably, with deionized water. The flushing is preferably effected by filling the anode space once and immediately releasing the flush liquid. The flushing can also be effected in two or more stages, for example in such a way that the anode space is first filled with dilute brine having an alkali metal chloride content of 1.5-2 mol/l and drained, and then filled further with highly dilute brine having an NaCl content of 0.01 mol/l or with deionized water and drained. The flush solution can be released again directly after the complete filling of the anode space or may reside for up to 200 min in the anode space and then be released. After the release, a small residual amount of flush solution remains in the anode space. Thereafter, the anode space remains encased or shut off, without direct contact to the surrounding atmosphere.

After emptying the anode space, catholyte still present is released from the cathode space, then the gas space of the cathode is flushed. The flushing is especially effected with highly dilute aqueous alkali having an alkali metal hydroxide content of up to 4 mol/l, with water or, preferably, with deionized water. The flushing is preferably effected by filling the gas space once and immediately releasing the flush liquid. The flushing can also be effected in two or more stages, for example by first filling with a dilute alkali having an alkali metal hydroxide content of 1.05-3 mol/l and draining, and then filling further with highly dilute alkali having an alkali metal hydroxide content of 0.01 mol/l or with deionized water and draining. The flush solution can be released again directly after the complete filling of the cathode space or may reside for up to 200 min in the cathode space and then be released. After the release, a small residual amount of flush solution remains in the cathode space. The cathode space remains encased or shut off, without direct contact to the surrounding atmosphere.

The oxygen supply can be switched off when the voltage is switched off. The oxygen supply is preferably switched off after the emptying and flushing of the cathode space; the orifice for the oxygen supply, in the course of filling, serves for venting or degassing of the cathode space.

After emptying anode space and cathode space, the electrolysis cell with the moist membrane can be kept ready for a short-notice startups in the installed state over a prolonged period, without impairing the performance of the electrolysis cell. In the case of shutdown periods extending over several weeks, it is appropriate, for stabilization, to flush or to wet the anode space with dilute aqueous alkali metal chloride solution and the cathode space with dilute aqueous alkali metal hydroxide solution at regular intervals. Preference is given to flushing at intervals of 1-12 weeks, particular preference to intervals of 4-8 weeks. The concentration of the dilute alkali metal chloride solution used for flushing or wetting is 1-4.8 mol/l. The flush solution can be released again directly after the complete filling of the anode space or may reside for up to 200 min in the anode space and then be released. The concentration of the alkali metal hydroxide solution used for flushing or wetting is 0.1 to 10 mol/l, preferably between 1 and 4 mol/l. The temperature of the brine or of the alkali metal hydroxide solution may be between 10 and 80° C., but preferably 15-40° C. The flush solution can be released again directly after the complete filling of the cathode space or may reside for up to 200 min in the cathode space and then be released.

A further embodiment of the process involves flushing the electrode spaces, which are understood to mean the cathode and anode spaces of the electrolysis cell, with moistened gas. For this purpose, for example, water-saturated nitrogen is introduced into the anode space. Alternatively, oxygen can also be introduced. The gas volume flow rate will measure such that a 2- to 10-fold volume exchange can be effected. The gas volume flow rate for a gas volume of 100 litres may be 1 l/h to 200 l/h at a temperature of 5 to 40° C., the temperature of the gas preferably being ambient temperature, i.e. 15-25° C. The purge gas is preferably saturated with water at the temperature of the gas.

The electrolysis cell which has been put out of operation by the above process is put back into operation by the process described previously. In the case of compliance with the process steps described, the electrolysis cell can pass through a multitude of running-up and -down cycles without any impairment in the performance of the cell.

EXAMPLES

Example 1

A powder mixture consisting of 7% by weight of PTFE powder, 88% by weight of silver(I) oxide and 5% by weight of silver powder was applied to a mesh of nickel wires and pressed to form an oxygen-consuming electrode. The electrode was installed into an electrolysis unit with an area of 100 $cm^2$ having an ion exchange membrane of the DuPONT N2030 type and a PW3MFBP carbon fabric from Zoltek with a thickness of 0.3 mm. The carbon fabric was installed between OCE and membrane. The electrolysis unit has, in the assembly, an anode space with anolyte feed and drain, with an anode made from coated titanium (mixed ruthenium iridium oxide coating), a cathode space with the OCE as the cathode, and with a gas space for the oxygen and oxygen inlets and outlets, a liquid drain and a carbon fabric, and an ion exchange membrane, which are arranged between anode space and cathode space. OCE, carbon fabric and ion exchange membrane were pressed onto the anode structure with a pressure of approx. 30 mbar by virtue of a higher pressure in the cathode chamber than in the anode chamber.

In the first step, the cathode space was filled with a 30% by weight sodium hydroxide solution at 30° C., having a content of chloride ions of 20 ppm and a content of chlorate ions of <10 ppm, and then immediately emptied again. In the course of emptying, oxygen was supplied, such that the resulting gas space was filled with oxygen. After emptying, a positive pressure of 30 mbar was established on the cathode side.

In the next step, the anode space was filled with brine having a concentration of 210 g NaCl/l at 30° C. and the anode circulation was put into operation, and the brine was heated to 70° C. Immediately after attainment of the temperature of the anode circuit, the electrolysis voltage was switched on. The electrolysis current was controlled such that a current density of 1 $kA/m^2$ was attained after 5 minutes, and a current density of 3 $kA/m^2$ after 30 minutes. The plant was operated over 3 days with a current density of 3 $kA/m^2$ and an electrolysis voltage of 1.90-1.95 V, a concentration of the sodium hydroxide solution removed of 32% by weight and a temperature in the electrolysis cell of 88° C.

Example 2

The electrolysis unit according to Example 1, after a run time of 3 days, was put out of operation as follows:

The electrolysis current switched off. The anolyte circuit was emptied. The anode chamber was filled to overflowing with deionized water and emptied again.

Thereafter, liquid remaining in the cathode space was released, the oxygen supply was switched off and the cathode space was filled to overflowing with deionized water and immediately emptied again.

50 h after the shutdown, the electrolysis unit from Example 2 was put back into operation as follows In the first step, the cathode space was filled with a 32% by weight sodium hydroxide solution at 80° C., having a content of chloride ions of 20 ppm and a content of chlorate ions of <10 ppm, and then emptied again. In the course of emptying, oxygen was supplied, such that the resulting gas space was filled with oxygen. After emptying, a positive pressure of 30 mbar was established on the cathode side.

In the next step, the anode space was filled with brine having a concentration of 210 g NaCl/l at 70°, and the anode circulation was put into operation. Immediately after attainment of constant running of the anode circulation, the electrolysis voltage was switched on. The electrolysis current was controlled such that an electrolysis current of 1 $kA/m^2$ was attained after 5 minutes, and an electrolysis current of 3 $kA/m^2$ after 30 minutes, at a concentration of the sodium hydroxide solution removed of 32% by weight and a temperature in the electrolysis cell of 88° C.

The electrolysis voltage at 3 $kA/m^2$ was 1.8 to 1.9 V. The electrolysis unit did not exhibit any deterioration compared to the period before the shutdown; in fact, an improvement by 100 mV was observed.

The invention claimed is:

1. Process for chloralkali electrolysis with an electrolysis cell in a micro-gap arrangement, with a distance of 0.01 mm to 2 mm between ion exchange membrane and oxygen-consuming electrode, the cell having at least one anode space with anode and an anolyte comprising alkali metal chloride, an ion exchange membrane, a cathode space at least comprising an oxygen-consuming electrode as the cathode, the cathode comprising a silver-containing catalyst, and comprising a flat, porous element arranged between the oxygen-consuming electrode and membrane, which porous element has a thickness of 0.01 mm to 2 mm and through which catholyte flows, and further comprising a gas space for an oxygen containing gas wherein application of the electrolysis voltage between anode and cathode is preceded, in a first step, by wetting of the oxygen-consuming electrode with an aqueous alkali metal hydroxide solution having a content of chloride ions of not more than 1000 ppm, and, after subsequent introduction of the anolyte into the anode space and of an oxygenous gas into the gas space of the cathode space, the electrolysis voltage is applied.

2. Process according to claim 1, wherein the alkali metal hydroxide solution used to wet the cathode space prior to application of the electrolysis voltage has a content of chlorate ions of not more than 20 ppm.

3. Process according to claim 1, wherein said electrolysis cell is an electrolysis cell which has previously been put out of operation.

4. Process according to claim 1, wherein the alkali metal chloride is sodium chloride or potassium chloride.

5. Process for chloralkali electrolysis with an electrolysis cell in a micro-gap arrangement, the cell having at least one anode space with anode and an anolyte comprising alkali metal chloride, an ion exchange membrane, a cathode space at least comprising an oxygen-consuming electrode as the cathode, the cathode comprising a silver-containing catalyst, and comprising a flat, porous element arranged between OCE and membrane, which porous element has a thickness of 0.01 mm to 2 mm and through which catholyte flows, and further comprising a gas space for an oxygen containing gas wherein, at the end of the electrolysis operation, for shutdown, at least the following steps are conducted in this sequence:

- lowering the electrolysis voltage and removing sufficient chlorine from the anolyte, to reach a content of less than 10 ppm of active chlorine in the anolyte
- cooling the anolyte to a temperature below 60° C. and emptying the anode space
- optionally refilling the anode space with one of the following liquids: dilute alkali metal chloride solution of not more than 4 mol/l or deionized water, with subsequent emptying of the anode space, and
- filling the cathode space with one of the following liquids: dilute alkali metal hydroxide solution of not more than 4 mol/l or deionized water, with subsequent emptying of the cathode space.

6. Process according to claim 5, wherein, after shutdown and emptying of the electrolysis cell, the anode space is flushed repeatedly every 1 to 12 weeks with a dilute alkali metal chloride solution having a content of 1.0 to 4.8 mol/l, and the cathode space with a dilute alkali metal hydroxide solution having a content of 0.1 to 10 mol/l.

* * * * *